US005540390A

United States Patent [19]

Orzechowski et al.

[11] Patent Number: 5,540,390

[45] Date of Patent: Jul. 30, 1996

[54] SPRAY BAR ASSEMBLY FOR A PRINTING PRESS

[75] Inventors: Thomas W. Orzechowski, Cicero; Thaddeus A. Niemiro, Lisle, both of Ill.

[73] Assignee: Rockwell International Corporation, Seal Beach, Calif.

[21] Appl. No.: 308,728

[22] Filed: Sep. 19, 1994

[51] Int. Cl.[6] ..... B05B 1/20; B41L 25/06

[52] U.S. Cl. ..... 239/550; 239/551; 239/583

[58] Field of Search ..... 239/583, 288, 239/288.3, 550, 562, 566, 150, 104, 551

[56] References Cited

U.S. PATENT DOCUMENTS

| | | | |
|---|---|---|---|
| 2,251,719 | 8/1941 | Sapp | 239/150 |
| 3,212,715 | 10/1965 | Cocks | 239/583 |
| 3,329,347 | 7/1967 | Montgomery | 239/583 |
| 4,353,505 | 10/1982 | Kinder | 239/288 |
| 4,759,506 | 7/1988 | Moore et al. | 239/426 |
| 5,078,325 | 1/1992 | Waryu et al. | 239/583 |

*Primary Examiner*—Karen B. Merritt
*Attorney, Agent, or Firm*—C. B. Patti; G. A. Montayne

[57] ABSTRACT

A spray bar assembly (10) for a printing press (12) having a source of liquid, at least one nozzle (42) communicating with the source, a pair of opposed elongated side walls housing the nozzle (42), a support member extending along the side walls, and an end baffle extending between the side walls near an end of the side walls, with the baffle being movably mounted on the support member to longitudinally adjust the position of the baffle relative to the side walls.

7 Claims, 5 Drawing Sheets

SPRAY BAR ASSEMBLY FOR A PRINTING PRESS

BACKGROUND OF THE INVENTION

The present invention relates to spray bar assemblies for a printing press.

In the past, spray bars have been utilized in a printing press to spray water onto a dampening roller for use by the press in conjunction with ink to print a web. Such spray bars have not produced a totally even distribution of sprayed water onto the dampening rollers, and have also been difficult to adjust and service.

SUMMARY OF THE PRESENT INVENTION

A principal feature of the present invention is the provision of an improved spray bar assembly for a printing press.

The spray bar assembly of the invention comprises a source of liquid, a nozzle for spraying the liquid on a dampening roller, and means for selectively opening and closing communication of the liquid between the source and the nozzle.

A feature of the invention is the provision of a chamber in which the opening and closing means communicates with a first end of the chamber, and in which the nozzle communicates with a second opposed end of the chamber.

Another feature of the invention is that the chamber and associated passageways results in a more even distribution of the liquid which is sprayed by the nozzle onto the dampening roller.

A further feature of the invention is that the assembly has a pair of opposed side walls housing the nozzle, and a resilient clip which holds the side walls in an operative position.

Another feature of the invention is that the clip may be easily removed from the side walls in order to move the side walls to an outwardly disposed configuration.

The assembly has a pair of end baffles adjacent the end of the side walls in order to control the spray of liquid adjacent opposed ends of the spray bar assembly.

A feature of the invention is that the baffles are longitudinally adjustable along the spray bar assembly even during operation of the press.

Another feature of the invention is that the side walls may be constructed from a flexible material, and the assembly has a pair of rigid bars secured along the side walls in order to stiffen the flexible side walls.

Further features will become more fully apparent in the following description of the embodiments of the invention, and from the appended claims.

DESCRIPTION OF THE PREFERRED EMBODIMENTS

Figure 2:
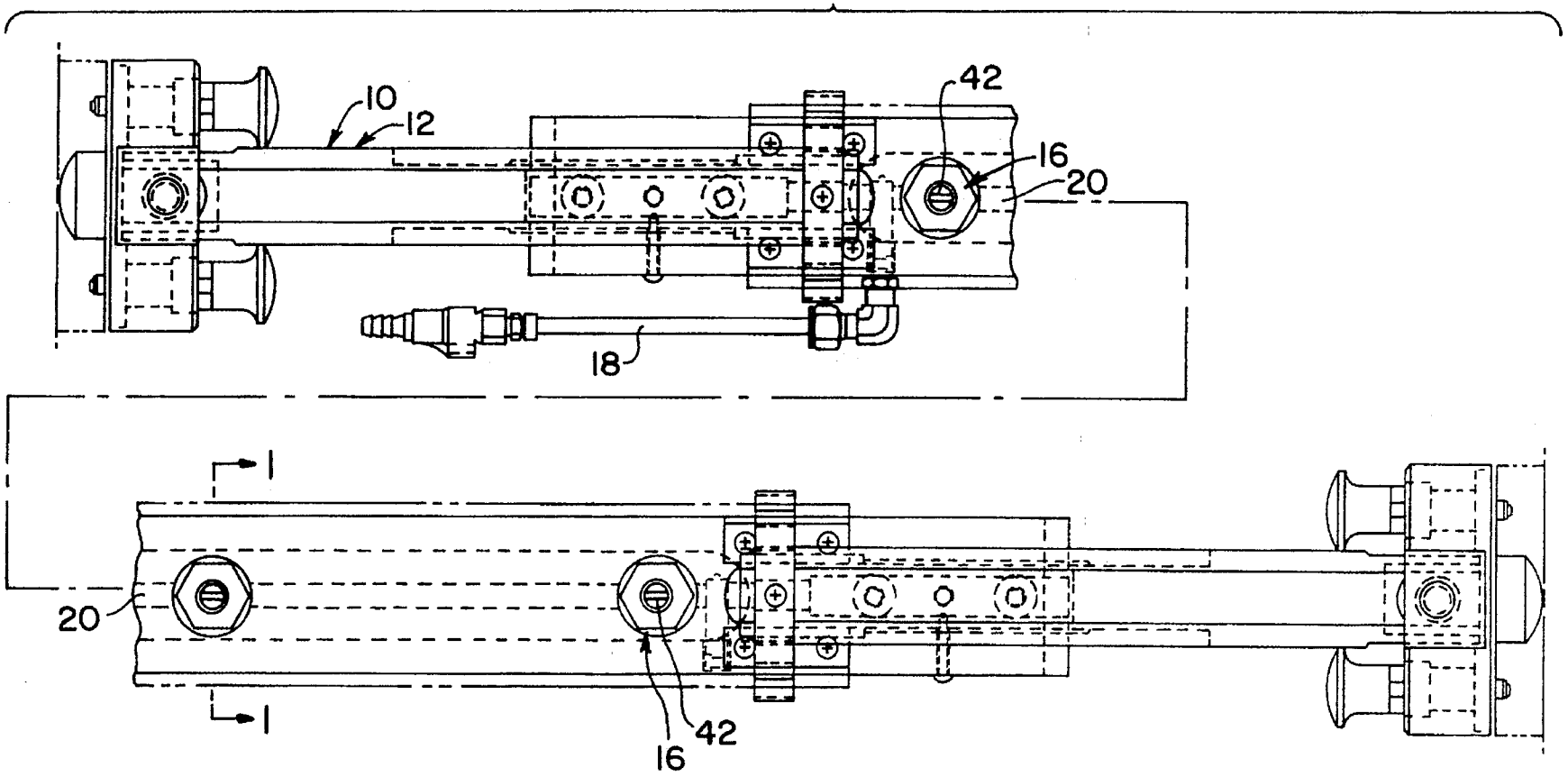
FIG. 2 is a fragmentary upper plan view of a spray bar assembly of the present invention.
Figure 3:
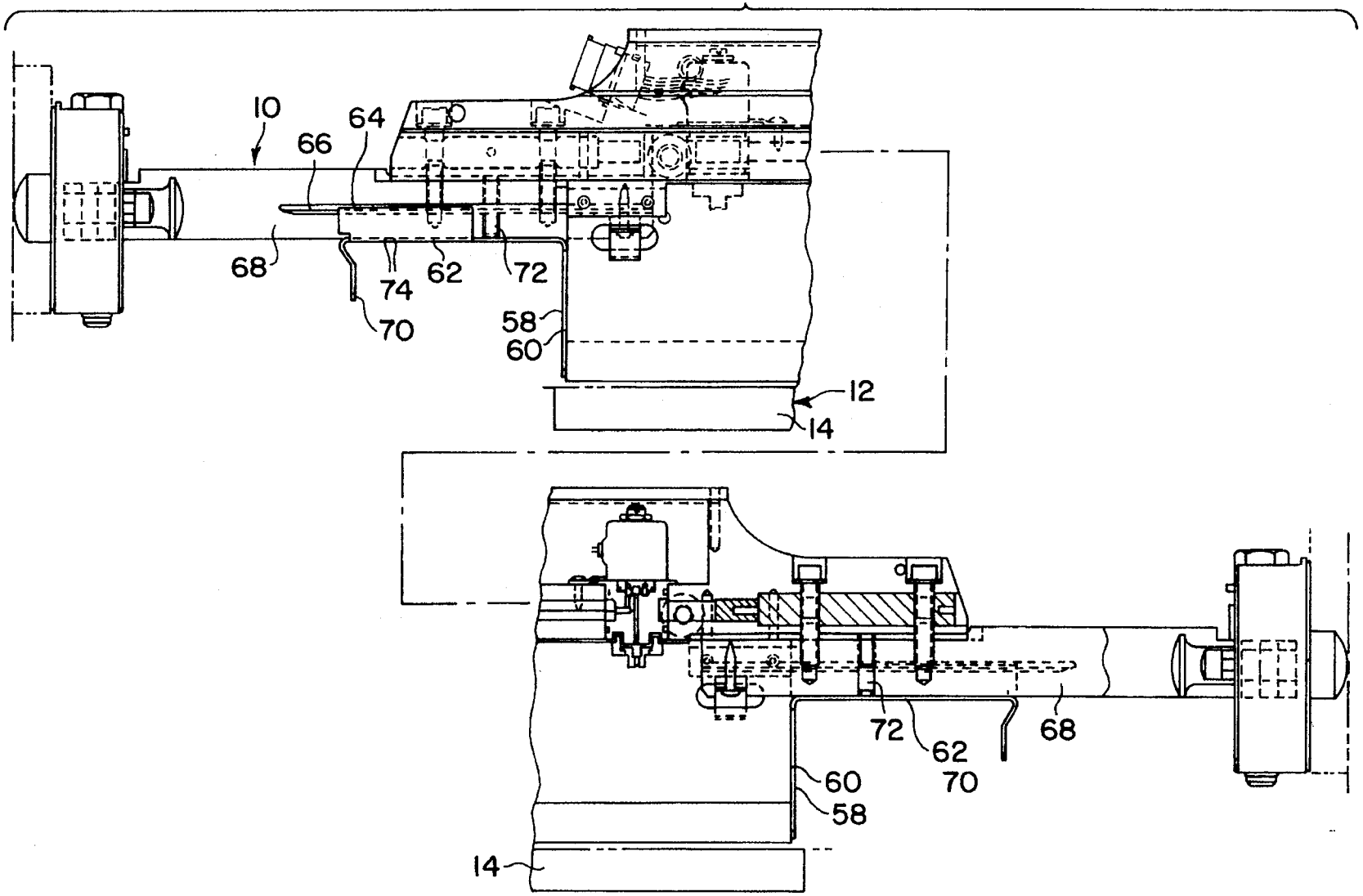
FIG. 3 is a fragmentary side elevational view of the spray bar assembly of FIG. 2.
Figure 4:
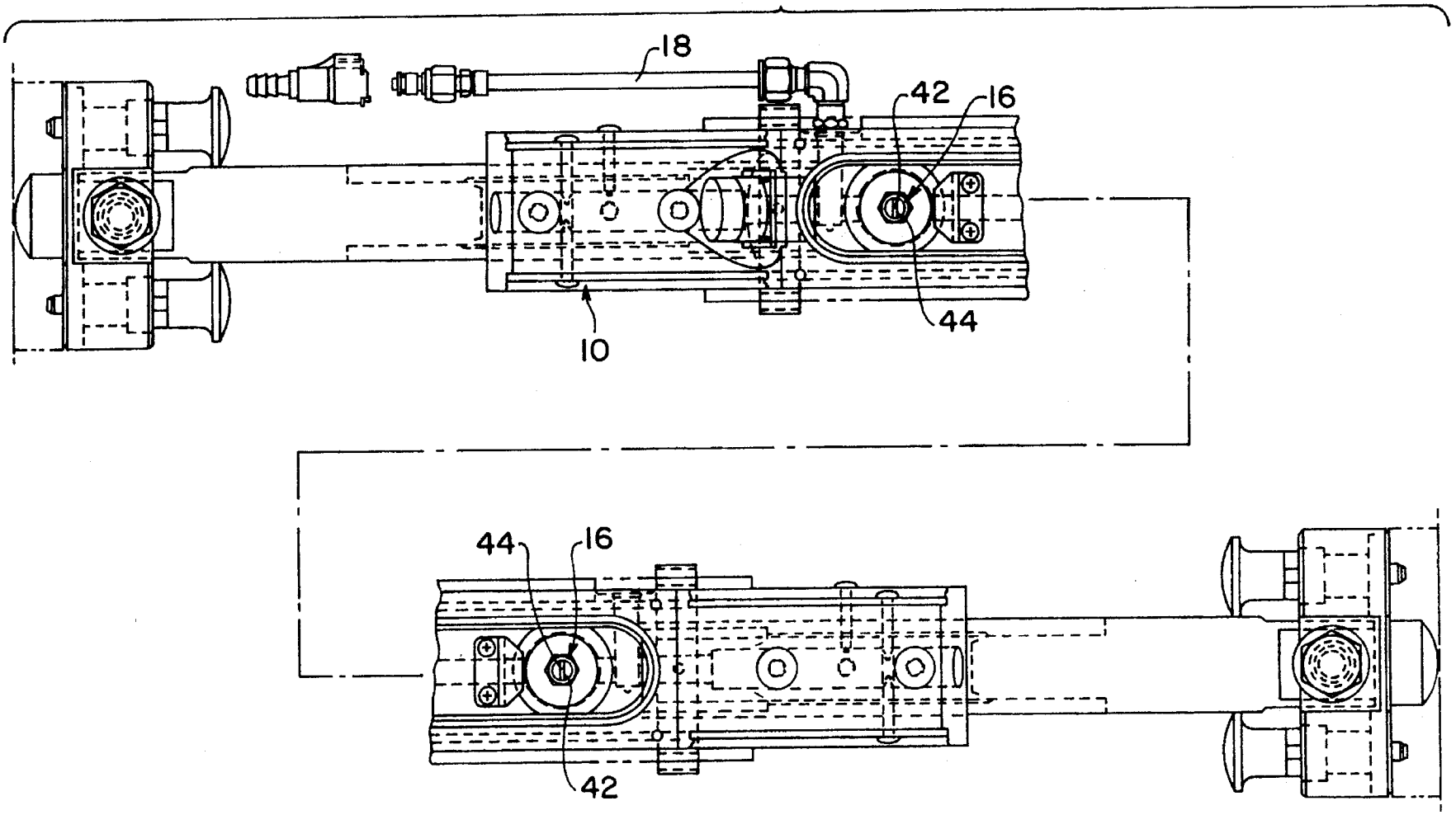
FIG. 4 is a fragmentary lower plan view of the spray bar assembly of FIG. 2.

Referring now to FIGS. 2–4, there is shown a spray bar assembly generally designated 10 for a printing press generally designated 12. The spray bar assembly sprays a liquid, such as water, onto a dampening roller 14 for use by the press 12 in conjunction with ink to print an image on a web. The assembly 10 has a plurality of nozzle assemblies, such as eight, generally designated 16 which accomplishes the spraying of the liquid onto the roller 14.

As shown, the assembly 10 has an inlet conduit 18 which communicates with a source of the liquid and an elongated channel 20 extending longitudinally along the spray bar assembly 10.

Figure 1:
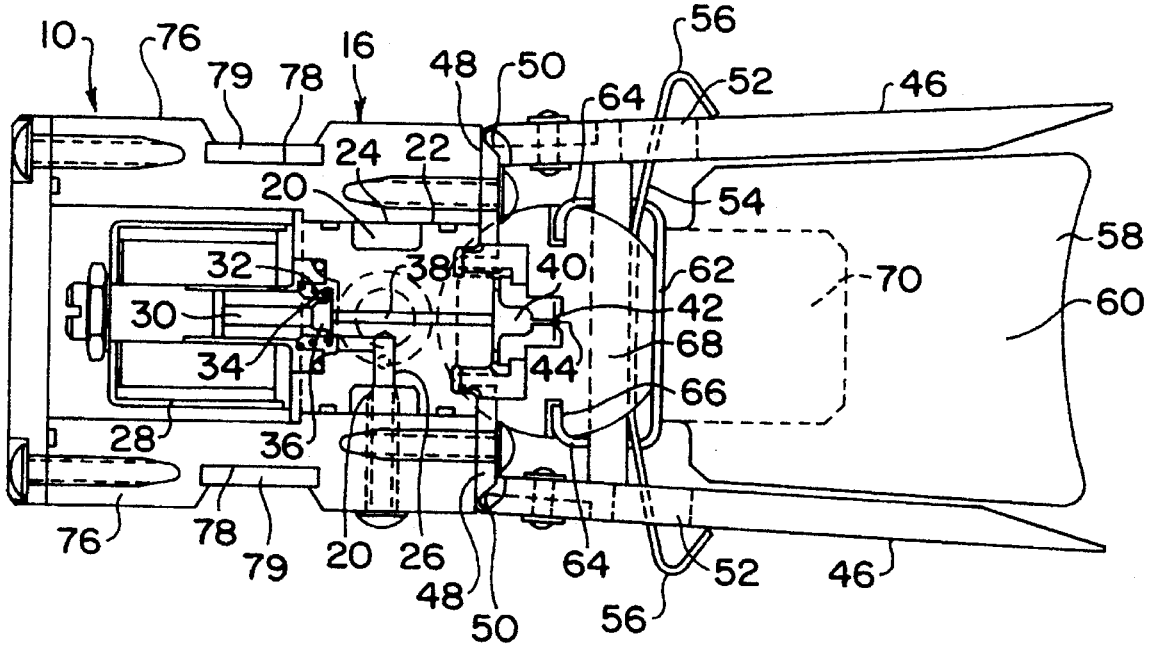
FIG. 1 is a sectional view of a nozzle assembly taken substantially as indicated along the line 1—1 of FIG. 2.
Figure 5:
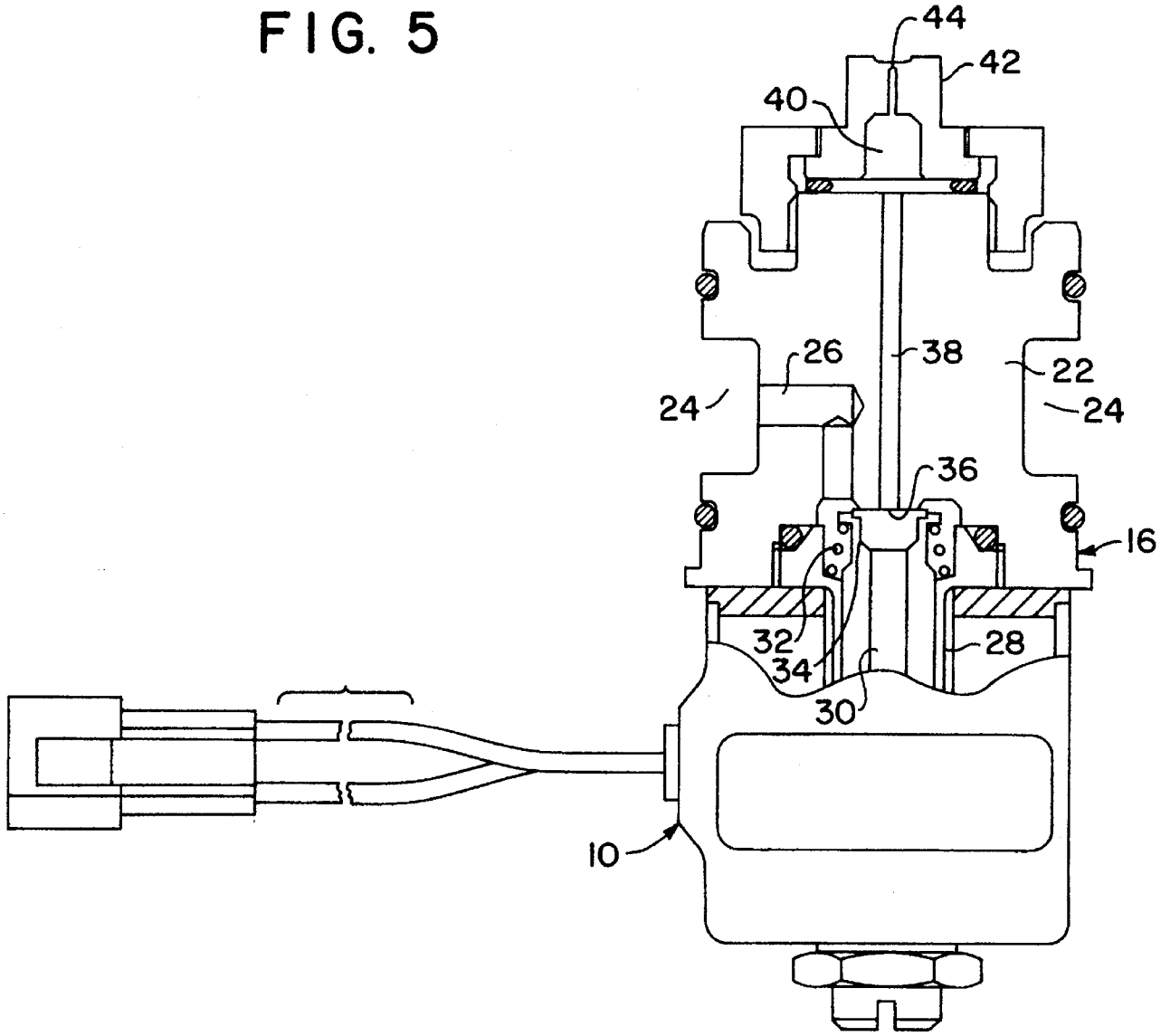
FIG. 5 is an elevational view of the nozzle assembly of FIG. 1.

As shown in FIGS. 1 and 5, the nozzle assemblies have a block 22 having an annular groove 24 which communicates with the channel 20 such that the liquid is permitted to pass into a single inlet first passageway 26 in a side of the block 22 and positioned in the groove 24 generally at right angles to the flow of liquid in the channel 20 which produces optimum results.

The nozzle assemblies 16 have a solenoid 28 having a plunger 30 which is movable between a first outer position and a second inner position with a helical spring 32 biasing the plunger outwardly towards its first position, with the outer end of the plunger 30 being located in a cavity 34. The outer end of the plunger 30 seats against the block 22 in order to close and open a port 36 at the inner end of a second passageway 38 in the block 22. As shown, the first passageway 26 communicates with the cavity 34, such that the plunger 30 permits communication between the first and second passageways 26 and 38 with the plunger 30 at its second inner position, and prevents communication between the first and second passageways 26 and 38 at its first outer position. In this manner, the plunger 30 of the solenoid 28 controls the passage of liquid through the nozzle assembly 16.

The assembly 16 has a chamber 40, and the outer end of the second passageway 38 communicates with an inner end of the chamber 40 at the surface of the block 22 defining the chamber 40. The assembly 16 has a nozzle 42 which communicates with an outer end of the chamber 40 in order for liquid to pass through the chamber 40 and nozzle 42 for spraying the dampening roller 14 through an outer orifice 44 in the nozzle 42. It has been found that a more even distribution of the sprayed liquid is attained with the second passageway 38 flush against the inner end of the chamber 40, and also prevents the passage of air into the chamber to produce optimum spraying.

As best shown in FIG. 1, the spray bar assembly 10 has a pair of opposed side walls 46 of flexible material, such as high density polyethylene, which are connected to inwardly directed flaps 48 by hinges 50 of one-piece construction with the side walls 46 and flaps 48, such that the side walls 46 are movable between a first parallel or aligned configuration, as shown, and an outwardly disposed configuration for service of the nozzle assemblies 16. The side walls 46 have a pair of aligned slots 52.

The assembly 10 has a resilient clip 54, such as metal, extending between the side walls 46 in their parallel configuration, with the clip 54 having a pair of opposed ends 56 extending through the slots 52 and bearing against an outer surface of the side walls 46 to maintain the side walls 46 in their aligned configuration. The ends 56 of the clip 54 are releasable from the side walls 46, and are receivable in the slots 52 in order to release the side walls 46 and permit movement of the side walls 46 to their outwardly disposed configuration generally perpendicular to the remainder of the assembly 10. The ends 56 of the clips 54 are passed through the slots 52 and are engageable against the outer surface of the side walls 46 in order to again retain the side walls 46 in their aligned configuration.

As best shown in FIGS. 1 and 3, the assembly 10 has a pair of opposed end baffles 58 extending between the side walls 46 near opposed ends of the side walls 46 to control the spray of liquid adjacent opposed ends of the spray bar assembly 10. The baffles 58 have a pair of outwardly directed end plates 60 which extend in an outer configuration near the side walls 46, a central plate 62 extending from the end plates 60, and a pair of opposed inwardly turned side ends 64 extending from the central plates 62 which are slidably received in elongated opposed grooves 66 in an elongated shaft 68, such that the baffles 58 are movable along the shaft 68 in order to adjust the end plates 60 relative to the side walls 46. The baffles 58 also have outwardly directed adjustment plates 70 at outer ends of the central plates 62 which may be grasped in order to adjust the position of the baffles 58 even while the press is in operation.

As shown in FIG. 3, the assembly 10 has outwardly biased pins 72 in the shaft 68 beneath the central plates 62 of the baffles 58 which are received in a plurality of longitudinally disposed indents 74 formed along the central plates 62. The pins 72 are received in the indents 74 as the baffles 58 are moved along the shaft 68 in order to releasably retain the baffles 58 at a desired position longitudinally along the shaft 68.

As shown in FIG. 1, the nozzle assemblies 16 have side walls 76 constructed from a flexible material, such as high density polyethylene, which house the assemblies 16. The side walls 76 extend along substantially the length of the spray bar assembly 10, and have longitudinally extending grooves 78. A pair of rigid bars 79 are received and secured in the grooves 78 in order to stiffen the side walls 76 during operation of the press 12.

The foregoing detailed description has been given for clearness of understanding only, and no unnecessary limitations should be understood therefrom as modification will be obvious to those skilled in the art.

We claim:

1. A spray bar assembly for a printing press, comprising:

a source of liquid;

at least one nozzle communicating with the source;

a pair of opposed side walls housing the at least one nozzle and being movable between a first parallel configuration to an outwardly disposed configuration, with the side walls having a pair of aligned slots; and a resilient clip extending between the side walls in the parallel configuration, with the clip having a pair of opposed ends extending through the slots and bearing against an outer surface of the side walls, with said clip being releasable from the outer surface of the side walls with the ends of the clip being received in the slots in order to move the side walls to the outwardly disposed configuration.

2. A spray bar assembly for a printing press, comprising:

a source of liquid;

at least one nozzle communicating with the source;

a pair of opposed elongated aligned side walls housing the at least one nozzle;

a support member extending along the side walls; and an end baffle extending between the side walls near an end of the side walls, said baffle being movably mounted on the support member to longitudinally adjust the position of the baffle relative to the side walls.

3. The assembly of claim 2 wherein the support member has a pair of opposed longitudinally extending grooves, and in which the baffle has a pair of opposed guide members slidably received in the support member groves in order to move the baffle along the support member.

4. The assembly of claim 2 including means for releasably retaining the baffle at a selected location.

5. The assembly of claim 4 wherein the retaining means comprises a plurality of indents in the baffle being spaced along the baffle, and an outwardly biased plunger in the support member and being selectively received in the indents.

6. A spray bar assembly for a printing press, comprising:

a source of liquid;

at least one nozzle communicating with the source;

a pair of opposed flexible side walls extending along substantially the length of the spray bar assembly, and each side wall having a longitudinally extending groove; and a pair of rigid bars received and secured in the grooves in order to stiffen the flexible side walls.

7. A spray bar assembly for a printing press, comprising:

a source of liquid;

wall means defining an elongated channel in the assembly communicating with the source; and a nozzle assembly having a solenoid having a plunger movable between a first outer position and a second inner position, a block having a groove extending peripherally around the block and being positioned in communication with the channel, said block having a single first passageway communicating with the groove and extending approximately at right angles from the flow of liquid in the channel and groove, with said plunger opening and closing said first passageway from a second passageway extending from the location of an outer end of the closed plunger, said block having a nozzle communicating with an outer end of a chamber, and with the second passageway communicating with an inner end of said chamber.

* * * * *